US007425244B2

(12) United States Patent
Paradis et al.

(10) Patent No.: US 7,425,244 B2
(45) Date of Patent: Sep. 16, 2008

(54) MOISTENING DEVICE FOR SEALING ENVELOPE FLAPS

(75) Inventors: Jason P Paradis, Orange, CT (US); Peter T Collings, Shelton, CT (US); Chipping Sye, Stamford, CT (US); Jihad Abdul-Rahiim, Brooklyn, NY (US)

(73) Assignee: Pitney Bowes Inc., Stamford, CT (US)

( * ) Notice: Subject to any disclaimer, the term of this patent is extended or adjusted under 35 U.S.C. 154(b) by 5 days.

(21) Appl. No.: 11/283,011

(22) Filed: Nov. 18, 2005

(65) Prior Publication Data

US 2007/0079938 A1 Apr. 12, 2007

Related U.S. Application Data

(60) Provisional application No. 60/725,086, filed on Oct. 7, 2005.

(51) Int. Cl.

| | |
|---|---|
| ***B43M 3/04*** | (2006.01) |
| ***B05C 1/02*** | (2006.01) |
| ***B05C 11/04*** | (2006.01) |
| *B05C 1/06* | (2006.01) |
| *B05C 11/11* | (2006.01) |

(52) U.S. Cl. ..... 156/442.4; 156/441.5; 156/442.2; 118/209; 118/256; 118/264

(58) Field of Classification Search ... 156/441.5–442.4; 118/209, 238, 242, 264, 256, 268, 503
See application file for complete search history.

(56) References Cited

U.S. PATENT DOCUMENTS

| | | | | |
|---|---|---|---|---|
| 4,643,123 | A | 2/1987 | Auerbach | |
| 4,903,633 | A | 2/1990 | Nobile et al. | |
| 4,926,787 | A * | 5/1990 | Fassman et al. | 118/32 |
| 5,088,442 | A * | 2/1992 | Joson et al. | 118/238 |
| 6,041,569 | A | 3/2000 | Freeman et al. | |
| 6,701,693 | B2 | 3/2004 | Benard et al. | |

* cited by examiner

*Primary Examiner*—Philip C Tucker
*Assistant Examiner*—Sonya Mazumdar
(74) *Attorney, Agent, or Firm*—Brain A. Lemm; Angelo N. Chaclas

(57) ABSTRACT

A moistening device that significantly reduces any loss of contact between the applicator and envelope flap regardless of the thickness of the mail piece or size of the flap, thereby ensuring sufficient wetting of the glue line on the envelope flap with moistening fluid, is provided. A deflection device is added to a portion of the support to which the applicator is secured. The deflection device is located and sized to exert a force on the applicator, causing the applicator to form into a shape that more closely matches the shape of an envelope flap being processed, while also allowing the applicator to flex slightly in multiple directions. This results in little to no loss of contact between the applicator and glue line on the envelope flap, thereby allowing sufficient moistening fluid to be transferred from the applicator to the glue line.

12 Claims, 4 Drawing Sheets

MOISTENING DEVICE FOR SEALING ENVELOPE FLAPS

CROSS REFERENCE TO RELATED APPLICATIONS

This application claims the benefit of U.S. Provisional Application Ser. No. 60/725,086, filed Oct. 7, 2005, the specification of which is hereby incorporated by reference.

FIELD OF THE INVENTION

The invention disclosed herein relates generally to mail processing systems, and more particularly to a moistening device for moistening an envelope flap of an envelope being processed by the mail processing system.

BACKGROUND OF THE INVENTION

Mail processing systems, such as, for example, mailing machines, inserters and the like, often include different modules that automate the processes of producing mail pieces. The typical mail processing system includes a variety of different modules or sub-systems each of which performs a different task on the mail piece. The mail piece is conveyed downstream utilizing a transport mechanism, such as rollers or a belt, to each of the modules. Such modules could include, for example, a singulating module, i.e., separating a stack of mail pieces such that the mail pieces are conveyed one at a time along the transport path, a stripping/moistening module, i.e., stripping open the flap of an envelope, wetting and sealing the glued flap of an envelope, a weighing module, and a metering/printing module, i.e., applying evidence of postage to the mail piece. The exact configuration of the mail processing system is, of course, particular to the needs of the user.

The stripping/moistening module includes a stripping blade for separating a flap of a moving envelope away from the envelope's body to enable the moistening and sealing process to occur. The stripping blade becomes inserted between the flap of the envelope and the body of the envelope as the envelope traverses the transport deck of the mailing machine. Once the flap has been opened, the moistening device moistens the glue line on the flap in preparation for sealing the envelope. One type of moistening system, known as a contact moistening system, generally deposits a moistening fluid, such as, for example, water or water with a biocide, onto the glue line on a flap of an envelope by contacting the glue line with a wetted applicator.

FIG. 1 illustrates a conventional stripper/moistening device 8. An applicator 10, typically formed from a contact media such as a brush, foam or felt, is held by a rigid support 12 that is secured the trailing edge 14 of the stripping blade 16. The applicator 10 is supplied with moistening fluid, either through physical contact with a wick (not shown), a portion of which is located in a reservoir containing the moistening fluid (not shown), or via a pump system and tubing (not shown). As an envelope, with the side having the flap facing down, is guided over the stripping/moistening device 8, the envelope body will pass over the top of the stripping blade 16 and support 12 while the envelope flap will pass under the stripping blade 16 and support 12. The inside of the envelope flap, where the glue line for sealing the flap is located, contacts the applicator 10, such that the applicator 10 transfers moistening fluid to the flap to activate the glue. The flap is then closed and sealed, such as, for example, by passing the closed envelope through a nip of a sealer roller to compress the envelope and flap together, and the envelope passed to the next module for continued processing.

There are problems, however, with conventional stripping/moistening modules as described above. For example, efficient sealing of the envelope flap is dependent upon the envelope flap making sufficient contact with the applicator to allow sufficient moistening fluid to be transferred from the applicator to the glue line on the envelope flap. If the glue line on the envelope flap does not receive sufficient moistening fluid, the glue will not activate and the flap will not seal. In many instances, the envelope flaps can buckle and pull away from the applicator, causing an insufficient amount of moistening fluid to be applied along the glue line on the flap. This is especially true of envelopes that include numerous inserts, i.e., thick mail pieces. FIG. 2 illustrates a cross-sectional view of the device 8 taken along line A-A' in FIG. 1 (perpendicular to mail flow) while a thick mail piece 20 is being processed. Thus, in FIG. 2, the mail piece 20 is moving in a direction out of the page. The mail piece 20 includes an envelope body 22, a flap 24, and contents 26. As can be seen from FIG. 2, the flap 24 is required to bend around the thickness of the contents 26, the support 12 and the applicator 10. Each of these elements effectively act as a wedge, forcing the envelope flap 24 away from the body 22. The amount of bending required increases as the thickness of these elements increases. Thus, as the thickness of the contents 26 of the mail piece 20 increases, the amount of bending required also increases. The amount of bending is also dependent upon the size of the flap. As the flap increases in size, the amount of bending required also increases. The bending of the flap 24 creates multiple contact points 28 between the flap 24 and the support 12, and the flap 24 and applicator 10. The contact points 28, in turn, force the envelope flap 24 further open in the direction indicated by arrows 30 due to the beam strength of the flap 24. This results in a loss of contact between the glue line 32 of the flap 24 and the applicator 10. In addition, differences in linear velocity between the flap 24 and envelope body 22, caused by the flap 24 having to move around the applicator 10 and support 12, cause the flap 24 to buckle along and perpendicular to the direction of movement of the mail piece 20. This buckling also causes a loss of contact between the glue line 32 of the flap 24 and the applicator 10.

The loss of contact between the glue line 32 of the flap 24 and applicator 10 results in the glue line 32 not receiving sufficient moistening fluid from the applicator 10 to activate the glue, and thus the flap 24 will not properly seal to the body 22. As the thickness of the mail piece increases, the amount of contact decreases, therefore making it difficult to reliably seal thick mail pieces. These problems are further exacerbated by the fact that envelopes are increasingly available in a variety of sizes with differently shaped flaps, and the different shapes can each be provided in different sizes. Thus, there exists a need for a moistening system that can better accommodate thick mail pieces and larger flaps to ensure reliable sealing.

SUMMARY OF THE INVENTION

The present invention alleviates the problems associated with the prior art and provides a moistening device that can reliably seal thick mail pieces and mail pieces with large flaps. The present invention provides a moistening device that significantly reduces any loss of contact between the applicator and envelope flap regardless of the thickness of the mail piece or size of the flap, thereby ensuring sufficient wetting of the glue line on the envelope flap with moistening fluid. This results in more consistent and reliable sealing of envelopes.

In accordance with the present invention, a deflection device is added to a portion of the support to which the applicator is secured. The deflection device is located and sized to exert a force on the applicator, causing the applicator to form into a shape that more closely matches the shape of an envelope flap being processed, while also allowing the applicator to flex slightly in multiple directions. By shaping the applicator to more closely match the shape of an envelope flap as the envelope is being processed and providing some flexibility in the applicator, there is little to no loss of contact between the applicator and glue line on the envelope flap, thereby allowing sufficient moistening fluid to be transferred from the applicator to the glue line. This provides for more reliable and more consistent sealing of the envelope flap to the envelope body.

Therefore, it should now be apparent that the invention substantially achieves all the above aspects and advantages. Additional aspects and advantages of the invention will be set forth in the description that follows, and in part will be obvious from the description, or may be learned by practice of the invention. Moreover, the aspects and advantages of the invention may be realized and obtained by means of the instrumentalities and combinations particularly pointed out in the appended claims.

DESCRIPTION OF THE DRAWINGS

The accompanying drawings illustrate presently preferred embodiments of the invention, and together with the general description given above and the detailed description given below, serve to explain the principles of the invention. As shown throughout the drawings, like reference numerals designate like or corresponding parts.

DETAILED DESCRIPTION OF THE PRESENT INVENTION

Figure 3:
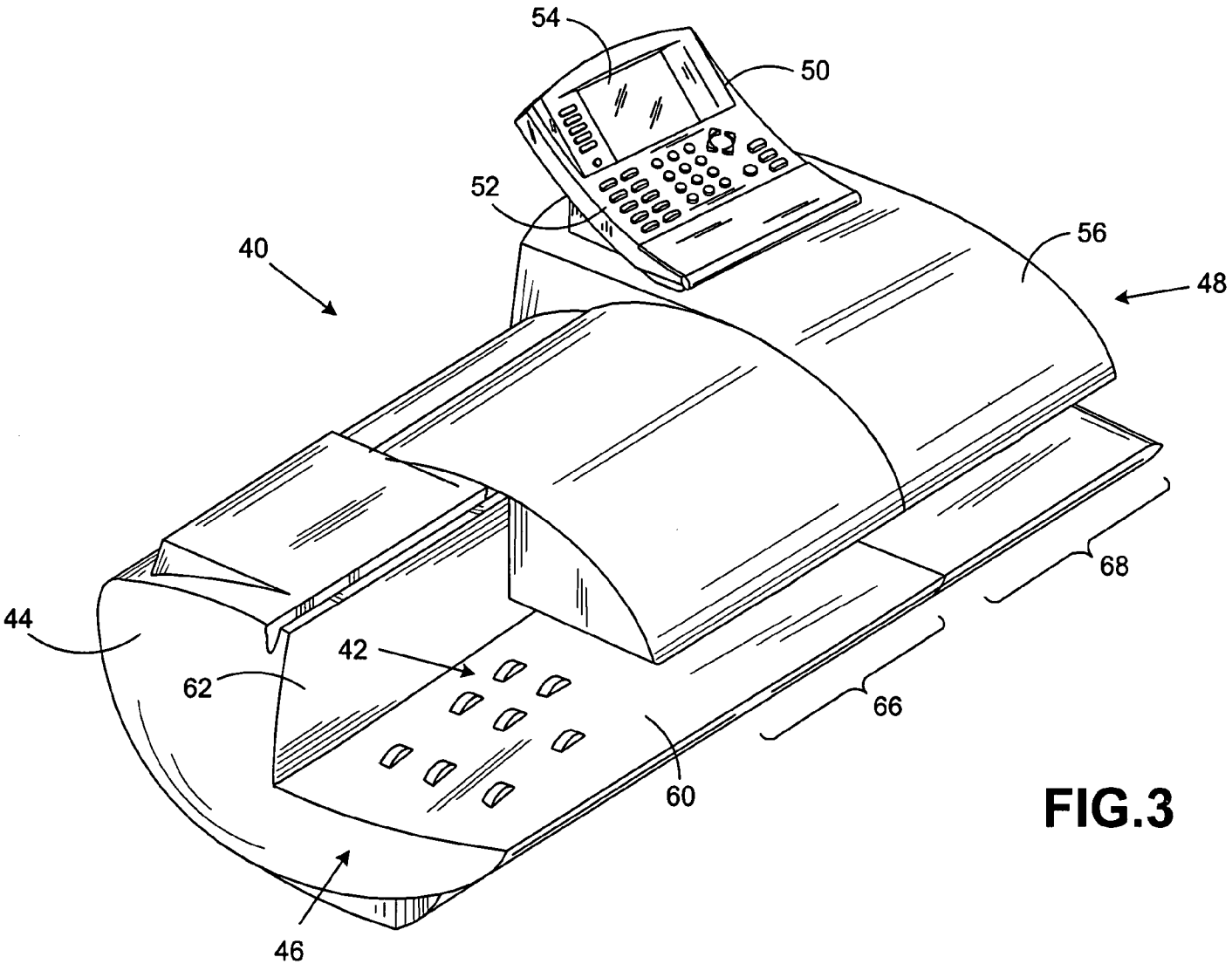
FIG. 3 illustrates a mailing machine in which the moistening device of the present invention can be utilized.

In describing the present invention, reference is made to the drawings, wherein there is seen in FIG. 3 a mailing machine 40 in which a moistening device according to the present invention can be utilized. Mailing machine 40 comprises a base unit, designated generally by the reference numeral 44, the base unit 44 having a mail piece input end, designated generally by the reference numeral 46 and a mail piece output end, designated generally by the reference numeral 48. A control unit 50 is mounted on the base unit 44, and includes one or more input/output devices, such as, for example, a keyboard 52 and a display device 54. One or more cover members 56 are pivotally mounted on the base 44 so as to move from the closed position shown in FIG. 3 to an open position (not shown) to expose various operating components and parts for service and/or repair as needed.

The base unit 44 further includes a horizontal feed deck 60 which extends substantially from the input end 46 to the output end 48. A plurality of nudger rollers 42 are preferably suitably mounted under the feed deck 60 and project upwardly through openings in the feed deck so that the periphery of the rollers 42 is slightly above the upper surface of the feed deck 60 and can exert a forward feeding force on a succession of mail pieces placed in the input end 46. A registration wall 62 defines a mail piece registration surface substantially perpendicular to the feed deck 60 that extends substantially from the input end 46 to the output end 48. Mail pieces placed in the input end 46 are fed by the nudger rollers 42 along the feed deck 60, with the top edge of the mail piece being registered against the wall 62. The mail pieces may be passed through one or more modules, such as, for example, a singulator module and an stripper/moistening module that can include the moistening device according to the present invention as described below. Each of these modules is located generally in the area indicated by reference numeral 66. The mail pieces are then passed to a metering/printing module located generally in the area indicated by reference numeral 68.

Figure 4:
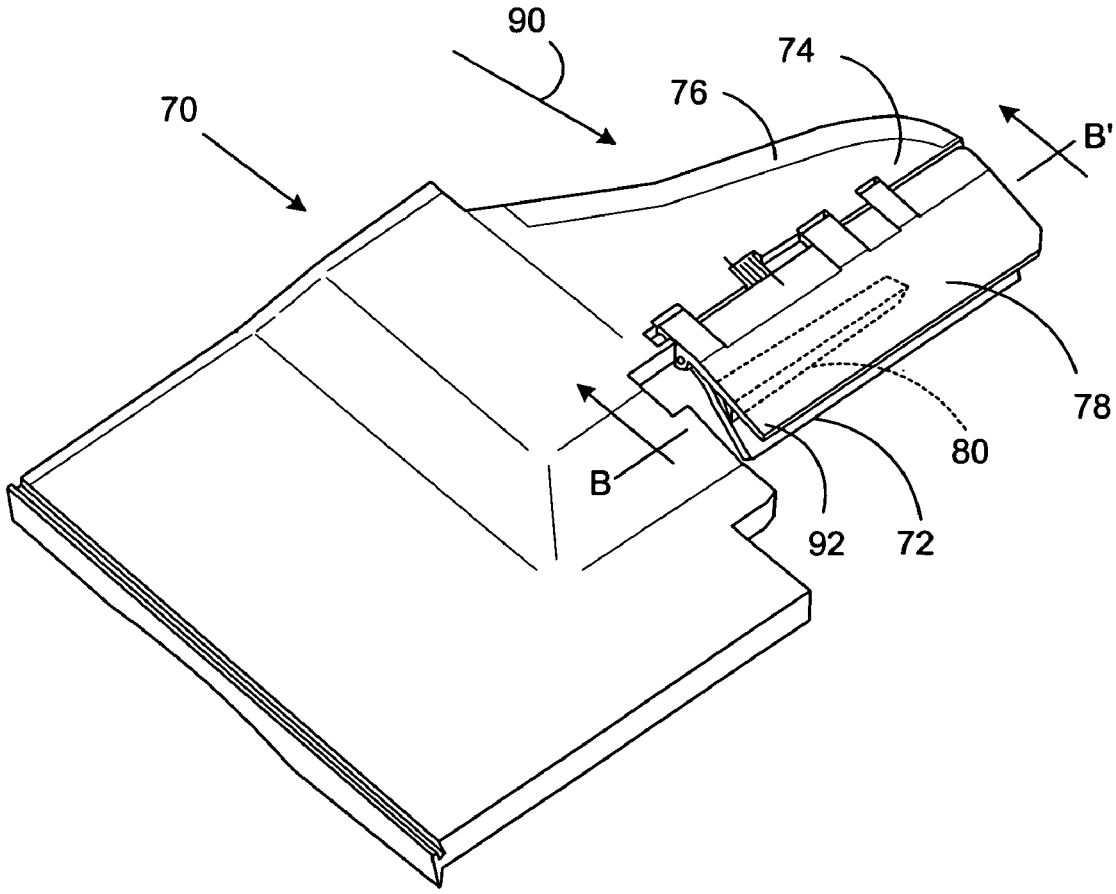
FIG. 4 illustrates a perspective view of a moistening device according to an embodiment of the present invention.

Referring now to FIGS. 4 and 5, there are illustrated a perspective view, side view and front view, respectively, of a moistening device 70 according to an embodiment of the present invention. The moistening device 70 could be used, for example to process a mail piece being transported through the mailing machine 40 of FIG. 3, and would be located near the registration wall 62 along the feed deck 60 generally in the area designated 66. The moistening device 70 can also be utilized in other types of mailing systems, such as, for example, an inserter.

Figure 5A:
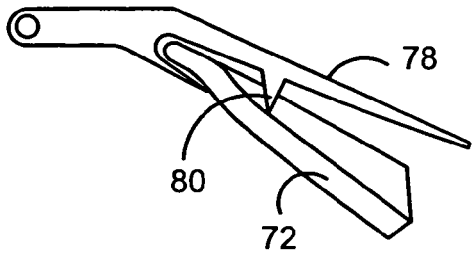
FIGS. 5A and 5B illustrate a side view and a front view, respectively, of a portion of the moistening device illustrated in FIG. 4.

As seen in FIG. 4, moistening device 70 includes a stripping blade 76 positioned to strip an envelope flap away from the body of the envelope as the envelope passes over the stripping blade 16. An applicator 72, preferably formed from a contact media such as a brush, foam or felt, is held by a rigid support 78 that is secured the trailing edge 74 of the stripping blade 76. The applicator 72 can be held, for example, in a channel or groove formed in the support 78. Preferably, as illustrated in FIG. 5A, the support 78 is angled with respect to the stripping blade 76 and pivotally secured to the trailing edge 74 with one or more torsion springs (not shown) providing a biasing force. The applicator 72 can be supplied with moistening fluid, either through physical contact with a wick (not shown), a portion of which is located in a reservoir containing the moistening fluid (not shown), or via a pump system and tubing (not shown).

Figure 5B:
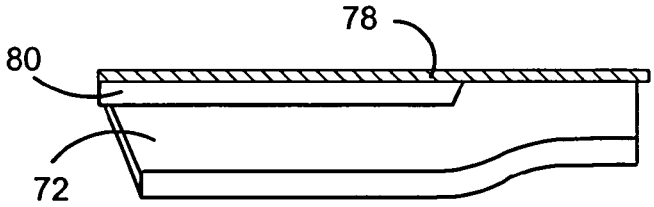

According to the present invention, the support 78 is provided with a deflection device to exert a force on a portion of the applicator 72 as described below. The deflection device could be, for example, a rib 80 on the bottom of the support 72 that extends along a portion of the support 78 in a direction transverse to movement of the mail pieces (illustrated by arrow 90). The rib 80 could be integrally formed with the support 78 or mounted to the support 78. The rib 80 preferably has a height of 2-3 mm. The rib 80 preferably starts near the edge 92 of the support 78 that is opposite the top edge of the envelope (where the flap is connected to the envelope body) and extends along a portion of the support 78 in a direction towards the top edge of the envelope, such as, for example, along some portion that is approximately one-half to three-quarters of the length of the support 78. The rib 80 preferably does not extend completely along the entire length of the support 78, as illustrated in FIG. 5B, as if the rib 80 were to extend too close to the edge of the support 78 opposite edge 92, it would act as an additional wedge tending to open the envelope flap 24 further from the envelope body 22. The deflection device could also be, for example, a spring, a combination spring/rib, or a plurality of small ribs that extend in the same direction as the movement of the mail pieces and are arranged in a row that extends in a direction transverse to the movement of the mail pieces.

The deflection device, e.g., rib 80, exerts a force on the applicator 72 such that the applicator 72 is pushed away from the support 78, and is therefore further from the support 78 along the portion of the support 78 where the rib 80 contacts the applicator 72 than the portion of the support 78 where the rib 80 does not contact the applicator 72. Thus, the rib 80 shapes the applicator 72 as best illustrated in FIG. 5B. Furthermore, the addition of the rib 80 causes the applicator 72 to be cantilevered, thereby allowing the applicator 72 to have a spring-like effect and allowing the applicator 72 to flex slightly in multiple directions.

Figure 1:
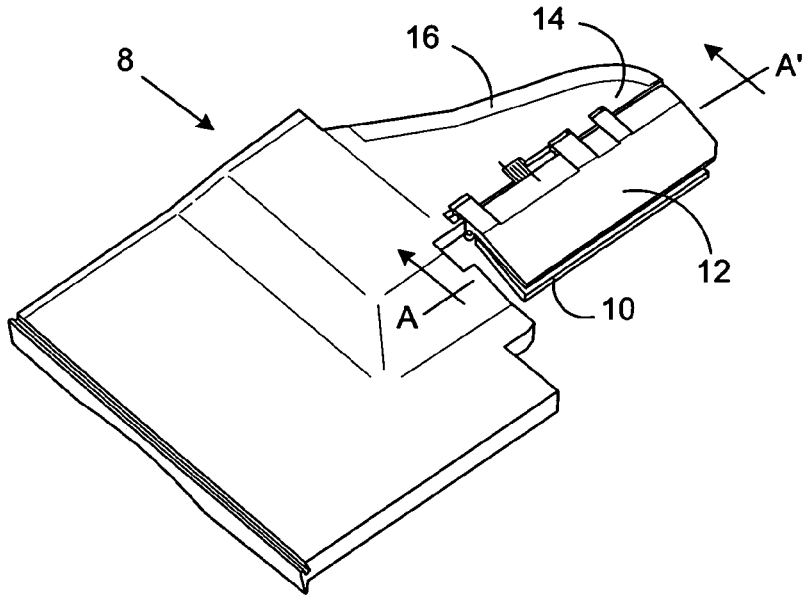
FIG. 1 illustrates a conventional stripper/moistening device.
Figure 2:
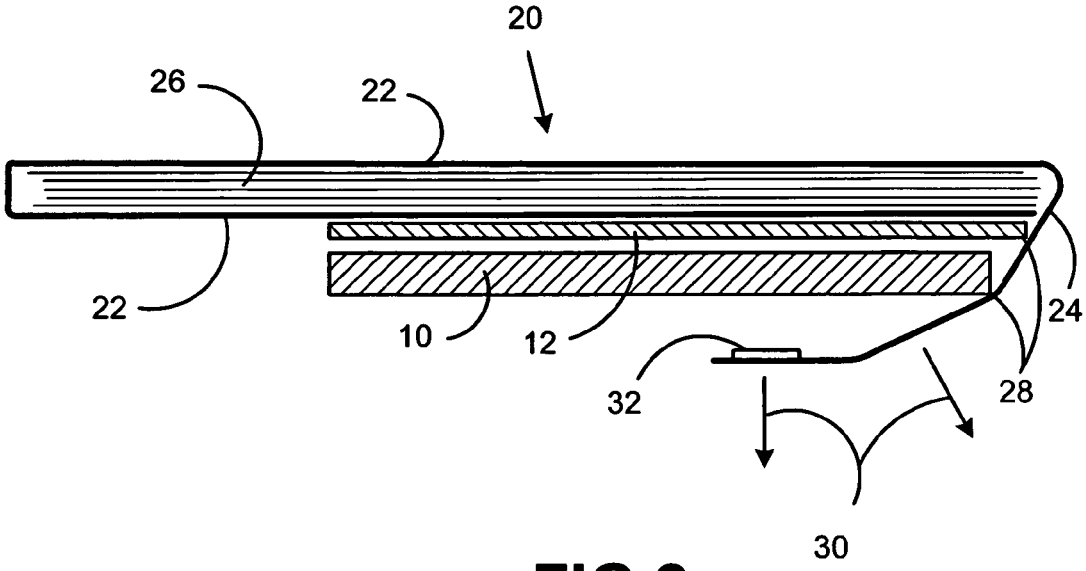
FIG. 2 illustrates a cross-sectional view taken along line A-A' of FIG. 1.
Figure 6:
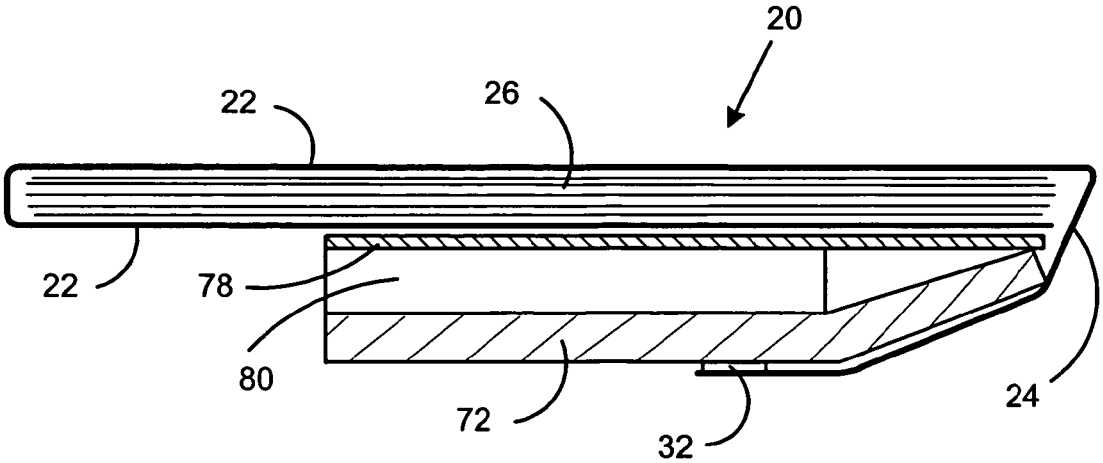
FIG. 6 illustrates a cross-sectional view taken along line B-B' of FIG. 4.

FIG. 6 illustrates a cross-sectional view of the moistening device 70 taken along line B-B' in FIG. 4 (perpendicular to mail flow direction illustrated by arrow 90) while a thick mail piece 20, similar to the mail piece 20 as illustrated in FIG. 2, is being processed. The mail piece 20 includes an envelope body 22, a flap 24, and contents 26. As can be seen from FIG. 6, the flap 24 is required to bend around the thickness of the contents 26, the support 78 and the applicator 72. Because of the rib 80, the applicator 72 is shaped to better match how the envelope flap 24 bends around the contents 26, support 78 and applicator 72. By adding the deflection device, e.g., rib 80, to the support 78, there is no loss of contact between the applicator 72 and glue line 32 on the flap 24. In addition, because the applicator 72 can flex slightly in multiple directions, the applicator 72 can compensate for any buckling of the flap 24, therefore remaining in contact with the flap 24 and allowing sufficient moistening fluid to be transferred from the applicator 24 to the glue line 32 of the flap 24.

As can be seen by comparing FIGS. 2 and 6, the moistening device 70 of the present invention allows the applicator 72 to maintain contact with the glue line 32 of the envelope flap 24, even for thick mail pieces or mail pieces with large flaps. This allows sufficient moistening fluid to be transferred to the glue line 32 from the applicator 72, which provides for more consistent and reliable sealing of the envelope flap 24 to the envelope body 22. Sealing tests performed using the moistening device 70 of the present invention resulted in significant improvements in the percentage of the flap sealed to the envelope body over a wide range of envelopes styles/sizes and thicknesses when compared with similar tests using the moistening device 8 as illustrated in FIG. 2. The moistening device 70 of the present invention resulted in an increase of up to seventy percent more of the flap being sealed as compared with the moistening device 8, especially in larger, thicker mail pieces.

While preferred embodiments of the invention have been described and illustrated above, it should be understood that these are exemplary of the invention and are not to be considered as limiting. Additions, deletions, substitutions, and other modifications can be made without departing from the spirit or scope of the present invention. Accordingly, the invention is not to be considered as limited by the foregoing description but is only limited by the scope of the appended claims.

What is claimed is:

1. A moistening device for moistening envelope flaps comprising:

an applicator for applying a moistening fluid to a glue line on an envelope flap;

a support piece for holding the applicator; and a deflection device located between the support piece and the applicator, the deflection device contacting a first portion of the applicator such that the first portion of the applicator is further away from the support piece than a second portion of the applicator that is not contacted by the deflection device.

2. The moistening device of claim 1, wherein the deflection device comprises a rib that extends along a portion of the support piece.

3. The moistening device of claim 2, wherein the rib is approximately 2-3 mm high.

4. The moistening device of claim 1, wherein the deflection device comprises a spring.

5. The moistening device of claim 1, wherein the deflection device comprises a plurality of ribs arranged in a row.

6. The moistening device of claim 1, wherein the deflection device is integral to the support piece.

7. A mailing system for processing mail pieces comprising:

a feed deck along which an envelope having an envelope body, an envelope flap and a top edge is fed in a first direction along a path of travel; and a moistening device, located along the feed deck, for moistening a glue line on the envelope flap, the moistening device comprising:

a stripper blade for separating the envelope flap from the envelope body;

an applicator for applying a moistening fluid to a glue line on an envelope flap;

a support piece for holding the applicator, the support piece secured to an edge of the stripper blade; and a deflection device located between the support piece and the applicator, the deflection device contacting a first portion of the applicator, the first portion being opposite the top edge of an envelope when an envelope is being processed by the moistening device, such that the first portion of the applicator is further away from the support piece than a second portion of the applicator not contacted by the deflection device, the second portion being near the top edge of an envelope when an envelope is being processed.

8. The mailing system of claim 7, wherein the deflection device comprises a rib that extends along a portion of the support piece in a direction transverse to the first direction.

9. The mailing system of claim 8, wherein the rib is approximately 2-3 mm high.

10. The mailing system of claim 7, wherein the deflection device comprises a spring.

11. The mailing system of claim 7, wherein the deflection device comprises a plurality of ribs extending in the first direction that are arranged in a row.

12. The mailing system of claim 7, wherein the deflection device is integral to the support piece.

* * * * *